US005861805A

United States Patent [19]

Reeves

[11] Patent Number: 5,861,805

[45] Date of Patent: Jan. 19, 1999

[54] DROP BOX SIGNALLING DEVICE

[76] Inventor: Mike Reeves, P.O. Box 307, Bradley, Ill. 60915

[21] Appl. No.: 948,249

[22] Filed: Oct. 9, 1997

[51] Int. Cl.[6] ..... G08B 1/08

[52] U.S. Cl. ..... 340/539; 340/568; 340/569; 340/613; 340/666; 340/570

[58] Field of Search ..... 340/539, 568, 340/569, 570, 612, 613, 617, 901, 905, 505, 614, 665, 666, 825.36

[56] References Cited

U.S. PATENT DOCUMENTS

| | | | |
|---|---|---|---|
| 1,336,652 | 4/1920 | Otto | 340/568 |
| 4,314,102 | 2/1982 | Lowe et al. | 340/568 |
| 4,794,377 | 12/1988 | Benages | 340/570 |
| 5,239,305 | 8/1993 | Murphy et al. | 340/569 |
| 5,448,220 | 9/1995 | Levy | 340/539 |
| 5,657,007 | 8/1997 | Anderson et al. | 340/904 |

*Primary Examiner*—Jeffery A. Hofsass

*Assistant Examiner*—Daryl C. Pope

*Attorney, Agent, or Firm*—Terrance L. Siemens

[57] ABSTRACT

Method and apparatus for effecting continuous automated querying of collection receptacles from a passing motor vehicle to ascertain whether articles have been deposited in each collection receptacle. Each collection receptacle has a detector capable of detecting whether at least one article has been placed within the collection receptacle, and a radio frequency transceiver. A motor vehicle provided for the purpose of collecting articles from the collection receptacles also has a transceiver. The transceiver of the motor vehicle continuously transmits a querying signal which is recognizable by the transceiver of each collection receptacle. When the detector has detected an article and a querying signal is received, the collection receptacle transmits an encoded response signal. This response signal is recognized by the transceiver of the motor vehicle, the identity of the transmitting collection receptacle is determined, and the results are annunciated to the operator of the motor vehicle. The detector or transceiver of the collection receptacle is reset after retrieval of articles deposited therein.

6 Claims, 2 Drawing Sheets

DROP BOX SIGNALLING DEVICE

BACKGROUND OF THE INVENTION

1. Field of the Invention

The present invention relates to monitoring of collection receptacles for receiving mail and articles to be transported to distant locations. More particularly, a novel monitoring system employs radio frequency communication between the collection receptacle and a passing motorized vehicle to enable the operator of the vehicle to whether to stop to empty the collection receptacle. This system would benefit the United States Postal System and large document shipping and delivery companies by eliminating necessity of stopping and manually ascertaining presence within each collection receptacle of articles to be transported or delivered.

2. Description of the Prior Art

Large document and package transporting and delivering organizations generally make available to the public unstaffed collection receptacles in locations convenient for customers. The delivery organization usually maintains a fleet of personnel for picking up and delivering articles. These personnel are usually charged with responsibility for removing articles deposited within such receptacles, and causing these articles to be routed to their ultimate destinations. Individual personnel pass a substantial number of collection receptacles, some of which may not have any articles deposited therein. Checking each receptacle can become tedious and time consuming. Therefore, a need for enabling fleet drivers to rapidly determine presence of articles to be retrieved exists.

The prior art has devised monitors for detecting presence of mail and similar articles placed in mailboxes. Such monitors transmit signals to remote annunciation panels, so that there is no necessity of manually checking mailboxes periodically to determine whether delivery has been made.

U.S. Pat. No. 4,794,377, issued to Alexander Benages on Dec. 27, 1988, and 5,239,305, issued to Colleen M. Murphy et al. on Aug. 24, 1993, describe automatic mailbox monitors employing radio frequency communication between the mailbox and a remotely located annunciator panel. Unlike the present invention, mere deposition of mail initiates radio signals from the mailbox. In the present invention, the remote component queries the receptacle. A return signal is generated if an object has been inserted into the receptacle. No return signal is generated if nothing has been placed in the receptacle.

U.S. Pat. No. 1,336,652, issued to Frank J. Otto on Apr. 13, 1920, describes a mail box monitoring system which annunciates mail deposited in a mail box. Annunciation signals are originated when mail inserted into the box displaces a feeler operating a switch closing a signalling circuit. This is a hard wired system, unlike the wireless remote signalling of the present invention. Also, there is no two way communication between two devices each having transmitting and receiving means.

U.S. Pat. No. 4,314,102, issued to Lynnwood Lowe et al. on Feb. 2, 1982, describes a system for monitoring a plurality of mail boxes ganged at one location. The system has a microprocessor for managing many signals, and communicates over a telephone system. Unlike the present invention, there is no radio frequency querying signal and radio frequency response generated when articles have been deposited in the receptacle.

None of the above inventions and patents, taken either singly or in combination, is seen to describe the instant invention as claimed.

SUMMARY OF THE INVENTION

The present invention provides a monitoring system enabling a fleet driver to pass a succession of collection receptacles and immediately determine presence of articles deposited for transport or delivery without requiring the driver to leave his or her vehicle. Each collection receptacle is provided with a detector detecting an article deposited within the receptacle. The receptacle has a radio frequency transceiver which can generate a signal confirming presence of the article responsive to the detector. The transceiver is quiescent until queried by a second transceiver located aboard the vehicle.

The vehicle transceiver emits signals querying the transceiver within the collection receptacle. These signals are of predetermined limited strength, so that they carry a limited distance from the vehicle. This assures that the vehicle transceiver is not deluged with a large number of responses, with a possible consequence that the operator could not determine which collection receptacles actually must be serviced.

Preferably, the response signal is encoded to assure that identity of the responding collection box will be correctly gauged by the operator of the vehicle. Also, when the operator has received a response indicating that an article has been deposited within a particular collection receptacle and should be retrieved, the article detector or response signal generator is reset to prevent spurious response signals.

In summary, the collection receptacle transceiver generates signals responsive to two conditions being met. One is that the detector has detected at least one article place within the receptacle. The second is that an authorized query is received. The driver of the vehicle may then drive along his or her route, making no unnecessary stops. Because the vehicle transceiver issues querying signals continuously, the driver need not make frequent or deliberate efforts to locate and query each receptacle. The process of servicing the route is thereby greatly expedited, and reduces demands made on the driver. This contributes to safety as well as to efficiency, since the driver is not distracted by having to monitor collection receptacles while driving.

Accordingly, it is a principal object of the invention to provide method and apparatus for automating checking of collection receptacles for deposition of articles deposited therein.

It is another object of the invention to provide a moving vehicle servicing a collection route with information regarding whether the vehicle is to stop at each one of individual designated collection points.

It is a further object of the invention to reduce demands made on drivers of vehicles servicing collection routes.

Still another object of the invention is to limit responses to queries issued within the collection vehicle to a predetermined radius, whereby a response may be associated with the collection receptacle nearest the vehicle.

An additional object of the invention is to assure that a response signal correctly identifies the collection receptacle originating the response.

It is again an object of the invention to prevent spurious or false responses.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
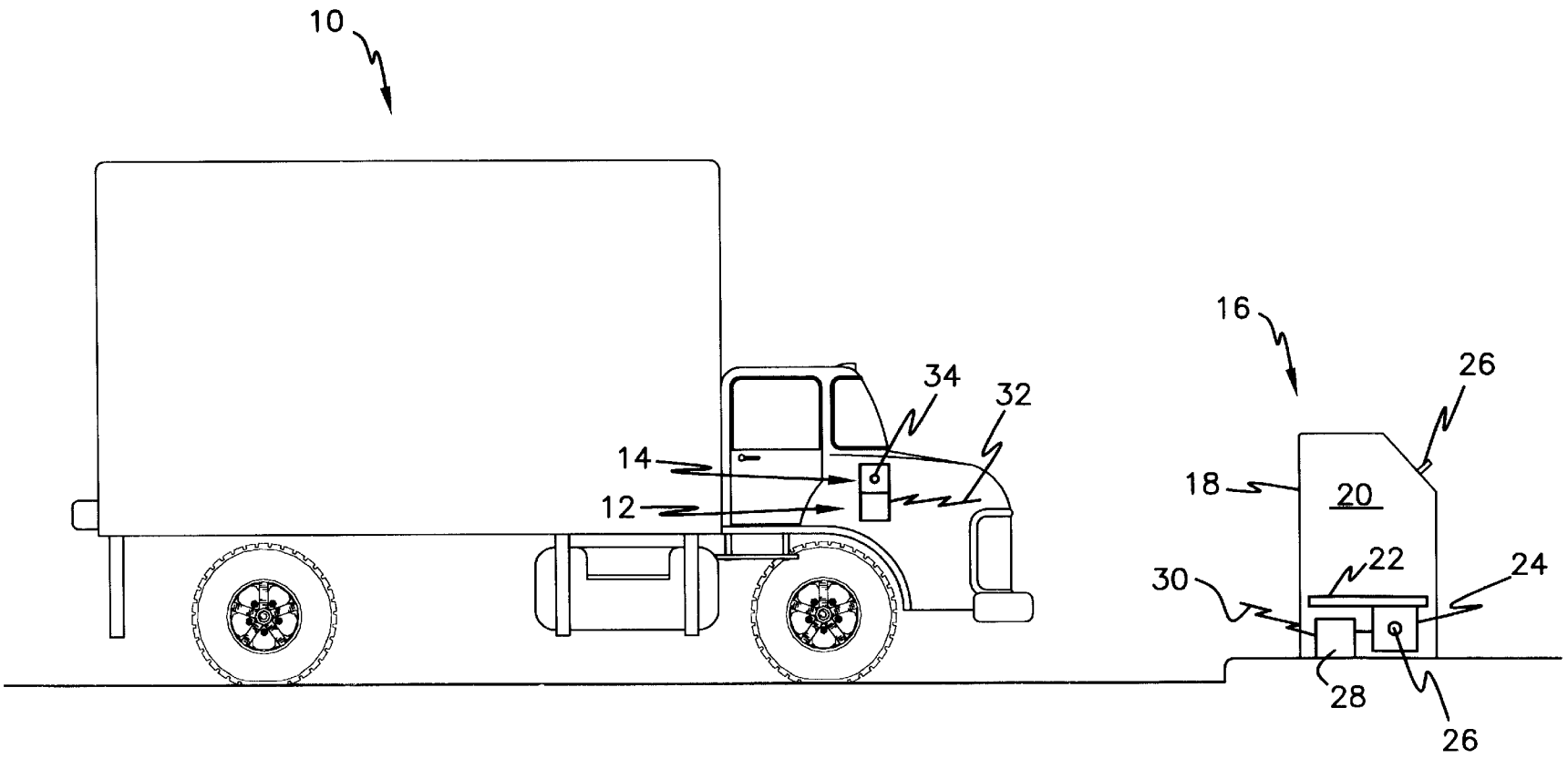
FIG. 1 is a an environmental, diagrammatic view of the apparatus of the invention.

Apparatus for carrying out the invention is shown in FIG. 1. A motor vehicle 10 is equipped with a radio transceiver 12 having a radio frequency receiver and transmitter (receiver and transmitter not separately shown), and annunciator panel 14. A collection receptacle 16 comprises an enclosure 18 enclosing a chamber 20 for receiving articles (not shown) to be shipped or delivered to a remote destination. A platform 22 operably connected to a weight actuated switch 24 forms the floor of chamber 20. When the weight of an article deposited into receptacle 16 through a door, represented by handle 26, is imposed upon platform 22, switch 24 completes a signal indicated at 30 to a transceiver 28 having a radio frequency receiver and transmitter (the receiver and transmitter are not separately shown). Alternatively, switch 24 may complete a partial circuit activating transceiver 28.

Receptacle 16 is typically a free standing metal structure located outdoors, and suitably anchored to its environment to deter theft. A plurality of receptacles 16 (only one receptacle 16 is illustrated) are distributed throughout a service area serving the general public. It is conventional practice to monitor receptacles 16 periodically, such as daily, to retrieve and ship or deliver articles placed in receptacles 16. Examples of receptacles 16 include mail boxes and similar collection receptacles maintained by well known express shipping and delivery companies such as Federal Express (TM), United Parcel Service (TM), and DHL (TM). However, the invention is equally susceptible to use by less well known or local shipping and delivery organizations, and for specialized purposes, such as collection of medical specimens, corporate or institutional mail, and others.

Motor vehicle 10 is any suitable vehicle, and is typically a panel truck, van or so called "minivan", or any other motorized vehicle, and could encompass boats, motorcycles, and even airplanes. Conventionally, vehicle 10 is a truck driven by an operator who must periodically park vehicle 10 and leave vehicle 10 to inspect conventional collection boxes (not shown), and to manually pick up and deliver articles.

To practice the present invention, querying signals, shown representatively at 32, are transmitted from transceiver 12 of vehicle 10. Signals 32 are of predetermined signal strength or are limited in any suitable way so that signal 32 activates only one transceiver 28 of a collection receptacle 16. Transceiver 28 is controlled so that response signal 30 is generated only when two conditions are met. The first condition is that querying signal 32 be received and recognized. The second condition is that switch 24 has been actuated by deposition of at least one article within chamber 20.

Signal 30 is preferably encoded with an identifying characteristic so that there is no chance of receiving a spurious or false signal. A spurious or false signal could be a signal generated by equipment or apparatus unrelated to that of the present invention. Alternatively, it could originate from a nearby collection receptacle 16, but not the collection receptacle 16 within view of or otherwise known to the operator of vehicle 10.

When a response signal 30 is received by transceiver 32, annunciator 14 produces a sensible indication. Indicator 34 is of any suitable sensible type, such as a light which illuminates responsive to reception of response signal 30, a buzzer or other audible alarm, a flag or other mechanical indicator which moves, turns color, or otherwise attracts the attention of the operator of vehicle 10. When indicator 34 indicates reception of a response signal 30, the operator is made aware of the need to retrieve articles from a predetermined collection receptacle 16. Upon doing this, he or she resets switch 24 by a reset button 36. Of course, the reset feature may act on transceiver 28 rather than switch 24, if desired.

Figure 2:
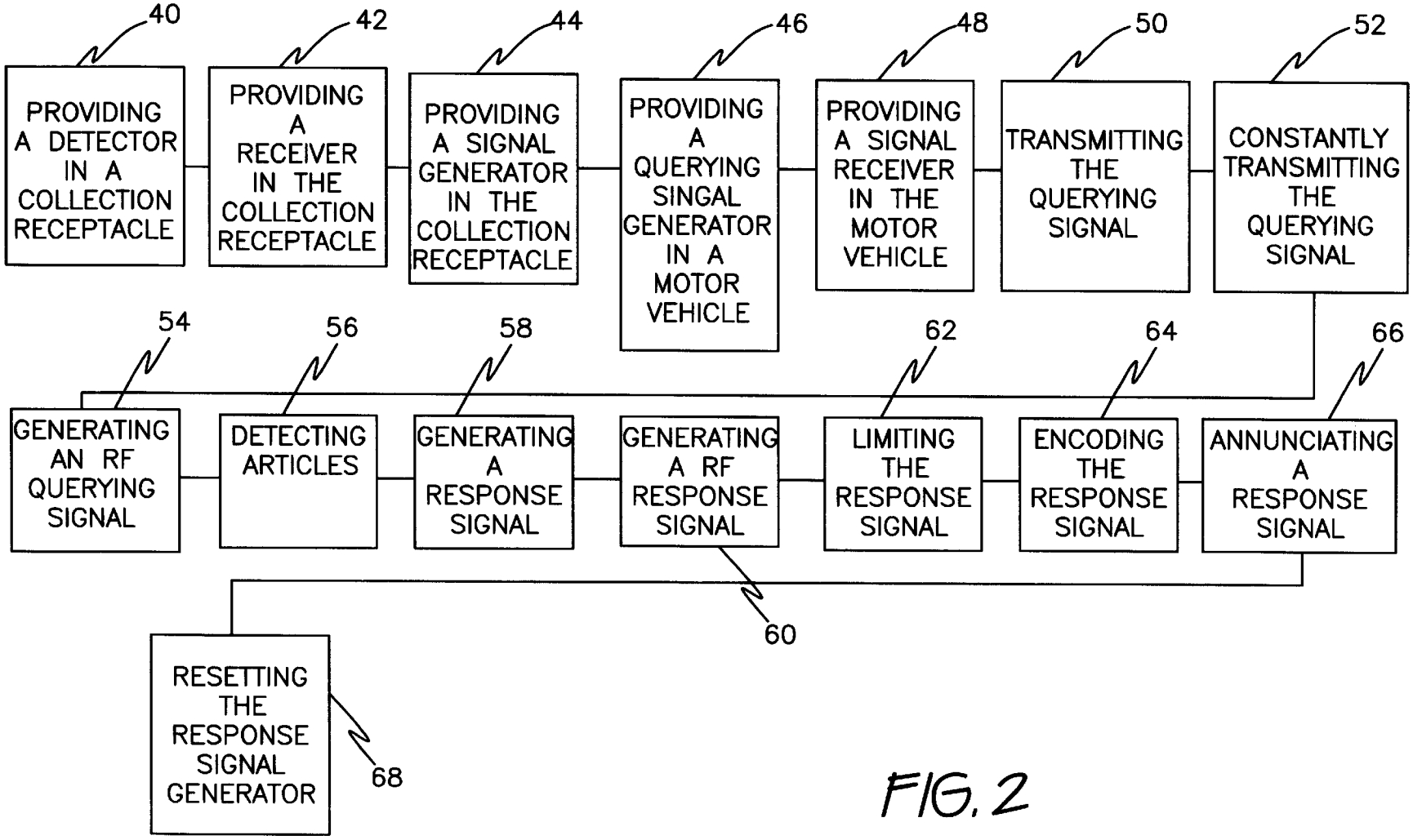
FIG. 2 is a block diagram summarizing steps of a method of practicing the invention.

The invention may be understood to comprise the apparatus described above, or alternatively, a method of determining presence of articles deposited in a stationary collection receptacle from a passing motor vehicle 10, as described below and as summarized in FIG. 2. The core or essential steps of the method are transmitting a querying signal 32 from motor vehicle 10, step 50; detecting presence of an article deposited into collection receptacle 16 by apparatus disposed within collection receptacle 16, step 56; and generating a response signal 30 responsive to both detecting presence of an article deposited within the collection receptacle and reception of querying signal 32, step 58. Steps 50, 56, and 58 collectively provide the basis of operation for automatically generating a positive response, that is, responding only when stopping vehicle 10 to retrieve deposited articles is actually warranted. Of course, when a response is not sensible to a human operator, a further step 66 of rendering response signal 30 in a sensible form perceptible to the operator is necessary.

Operation of the system is, of course, predicated upon providing the apparatus. Therefore, the method may be expanded to include providing collection receptacle 16 with a detector 22, 24 capable of determining whether at least one article has been deposited within collection receptacle 16, shown as step 40; providing collection receptacle 16 with a signal receiver 28 capable of receiving and recognizing a querying signal 32, step 42; providing collection receptacle 16 with a response signal generator 28 capable of responding to a querying signal 32 responsive to both detection of a deposited article and reception of a querying signal 32, step 44; and providing motor vehicle 10 with a querying signal generator 28, step 46, whereby collection receptacle 16 can detect articles deposited therein, detect querying signals 32, and respond to a passing motor vehicle 10 when an article has been deposited within collection receptacle 16.

It is possible that querying signal 32 be other than a radio frequency signal, although this type of communication is preferred due to ability to negotiate solid objects (not shown) interposed between transceivers 12 and 28. The signal could be infrared, sonic or ultrasonic, laser, heat, vibration, pressure, or any other form of energy. It is also not necessary that the response take the form of radio frequency response signal 30. An audible or visible signal (not shown) may be generated at collection box 16, such as a light, buzzer, mechanical flag, or other sensible signal. If a non-sensible energy signal is employed, there is no requirement that it be of nature similar to that of the querying signal. Rather, it need only be capable of being sensed within vehicle 10, either by the operator or by equipment generally analogous to transceiver 12. Therefore, there is no necessity that the novel method be limited to include the following steps of a preferred embodiment.

In a further step 48, motor vehicle 10 is provided with a response signal receiver 12 and annunciator 14, whereby a response signal 30 may be received and annunciated within motor vehicle 10.

It is preferred to generate radio frequency signals for both querying signals 32 and response signals 30, as summarized in steps 54 and 60. Signals 30, 32 can be limited in their range by adjustment of power, so that reception is limited to those transceivers 12, 28 located within a predetermined proximity to one another. Normally, collection receptacles 16 (only one shown) are spaced apart to assure maximal geographic coverage. Therefore, as vehicle 10 approaches each succeeding collection receptacle 16, that one collection receptacle 16 will be the only one within effective communicating range. Thus, there is no question as to which collection receptacle 16 is responding should a response signal 30 be generated and detected within vehicle 10. Thus it would be appropriate to limit either querying signal 32 or response signal 30 or both in a manner assuring effective identification of the responding collection receptacle 16, as shown in step 62.

For security and identification purposes, it is possible to encode either querying signal 32 or response signal 30 or both. This is readily achieved by selecting broadcast frequencies appropriately, or by many methods well known in the art, and need not be set forth in detail herein. Step 64 shows a preferred encoding scheme, that of encoding response signal 30. It is possible, after all, for a plurality of collection receptacles 16 to be present within effective range of transceiver 12. Therefore, correct identification is assured by an appropriately encoded response signal 30.

Reception of a signal of radio frequency or other non-sensible energy form requires that the signal be converted to sensible form perceptible to the operator of vehicle 10. Under these conditions, a step 66 of annunciating response signal 30 is practiced. Of course, step 66 will be understood to include decoding encoded signals, where required, and generating operating signals for actuating indicator 34 of annunciator 14.

A preferred mode of operation entails generating querying signal 32 continuously in the vicinity of collection receptacles 16, as summarized in step 52. Continuous transmission of signal 32 causes automatic operation of the process of querying and responding, thereby freeing the driver to devote full attention to driving.

When the operator of vehicle 10 is apprised of a collection receptacle 16 having an article which must be retrieved for subsequent shipping or delivery, he or she stops at the responding collection receptacle 16, retrieves articles deposited therein, and resets a response signal generating component of the emptied collection receptacle 16. This component may be switch 24, resetting being accomplished by pressing reset button 36. If the detector is a member (not shown) displaced by deposition of an article into chamber 20, such as a trip bar, feeler, or the like, such a member may be restored to its initial position. Alternatively, it may be transceiver 28 that is reset. Resetting is summarized as step 68.

The apparatus and method of the present invention are susceptible to variations and modifications which may be introduced without departing from the inventive concept. For example, collection receptacle 16 need not be as described above. It may be indoors, fabricated in any suitable way, and may or may not have a door for opening.

Detection of articles placed within collection receptacle may be of any suitable type. A light detector detecting opening of a door, interruption of a beam of light, displacement of a feeler arm or intermediate conduit leading to chamber 20, or any other type of detector may be employed, depending upon the type of articles to be detected and conditions warranting detection.

It is to be understood that the present invention is not limited to the embodiments described above, but encompasses any and all embodiments within the scope of the following claims.

I claim:

1. An apparatus for determining the presence of a package in a receptacle and for further notifying an operator of a vehicle in proximity of said receptacle of the package's presence comprising:

a package sensing means comprising a weight sensing switch located in said receptacle;

a querying signal transceiver located in the vehicle;

a receptacle transceiver adapted to receive a query signal generated by said querying signal transceiver, and if said weight sensing switch of said package sensing means has been activated by a deposit of a package in said receptacle, to transmit a signal indicative of the presence of the package to said querying transceiver in the vehicle; and indicator means activated by said signal indicative of the presence of the package, for indicating to the operator of the vehicle that said weight sensing switch of said package sensing means in said receptacle has been activated; whereby as the vehicle approaches said receptacle, said querying signal is received by said receptacle transceiver, and if said weight sensing switch of said package sensing means has been activated, said receptacle transceiver transmits a signal indicative of the presence of a package in said receptacle and said indicator means is activated, thus notifying the operator of the vehicle that a package is present in said receptacle.

2. The apparatus according to claim 1, wherein said querying signal transceiver includes a low powered, short range transmitter.

3. The apparatus according to claim 1, wherein said querying signal is constantly transmitted.

4. The apparatus according to claim 1, wherein said signal indicative of the presence of a package in said receptacle is encoded.

5. The apparatus according to claim 1, further including a weight sensing switch reset means whereby said weight sensing switch is deactivated when a package is removed from said receptacle.

6. The apparatus according to claim 1 wherein said querying signal is transmitted on a first frequency and said signal indicative of the presence of a package is transmitted on a second frequency.

* * * * *